US005277039A

United States Patent [19]

Haasis

[11] Patent Number: 5,277,039

[45] Date of Patent: Jan. 11, 1994

[54] CABINET REFRIGERATION UNIT

[75] Inventor: Hans Haasis, Goleta, Calif.

[73] Assignee: Omnimet Industries, Inc., Downey, Calif.

[21] Appl. No.: 790,333

[22] Filed: Nov. 12, 1991

[51] Int. Cl.[5] ..... F25D 23/12

[52] U.S. Cl. ..... 62/448; 62/263; 62/411

[58] Field of Search ..... 62/440, 408, 419, 411, 62/448, 263, 237

[56] References Cited

U.S. PATENT DOCUMENTS

| | | | |
|---|---|---|---|
| 2,468,466 | 4/1949 | Shanis | 62/419 |
| 2,515,766 | 7/1950 | Earle | 62/448 |
| 2,807,939 | 10/1957 | Cole | 62/440 |
| 2,912,834 | 11/1959 | Mann | 62/419 |
| 3,159,983 | 12/1964 | Metcalfe | 62/262 |
| 3,232,072 | 2/1966 | Barroero | 62/256 |
| 3,577,744 | 5/1971 | Mercer | 62/256 |
| 3,699,870 | 10/1972 | Cantagallo | 98/10 |
| 3,871,188 | 3/1975 | Vold et al. | 62/298 |
| 4,457,140 | 7/1984 | Rastelli | 62/440 |
| 4,821,530 | 4/1989 | Ledbetter | 62/332 |
| 4,907,419 | 3/1990 | Kruck et al. | 62/263 |
| 4,958,500 | 9/1990 | Kuroda et al. | 62/263 |

*Primary Examiner*—Henry A. Bennet
*Assistant Examiner*—William C. Doerrler
*Attorney, Agent, or Firm*—Poms, Smith, Lande & Rose

[57] ABSTRACT

A cabinet refrigeration system suitable for use in a wide variety of refrigeration cabinets is disclosed. The system includes a cabinet for storing or displaying refrigerated food and a thin, self-contained refrigeration unit of unitary construction removably mounted on the inner surface of one of the walls of the cabinet thereon by making it easily replaced, repaired or moved to a different cabinet. The cabinet may have drawers, shelves, bins or other food storage or display receptacles that may be accessed either through the front or the top of the cabinet. The refrigeration unit operates by drawings warm air into the bottom of the unit and expelling cold conditioned air out of the top of the unit. Adjustable deflectors are mounted on the outside of the refrigerator unit at the unit's output vent for precisely controlling the direction of flow of the cold air exiting the refrigeration unit.

12 Claims, 3 Drawing Sheets

FIG. 1
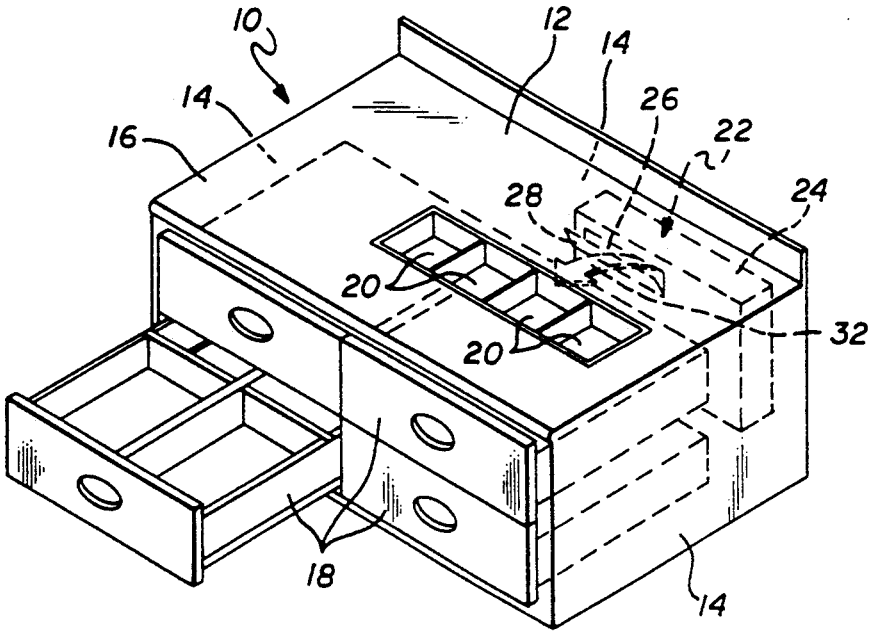
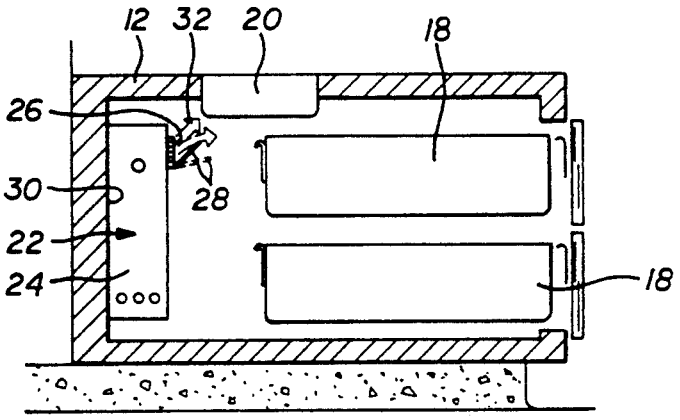
FIG. 2
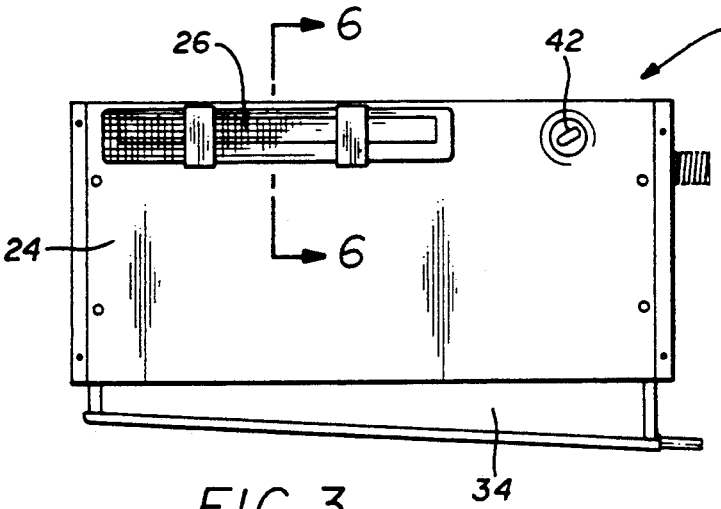
FIG. 3
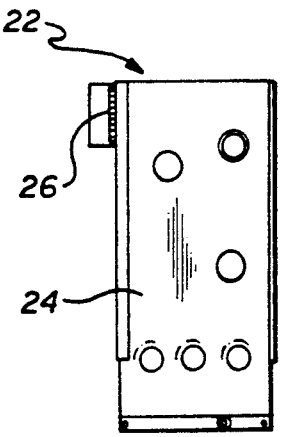
FIG. 4

FIG. 5
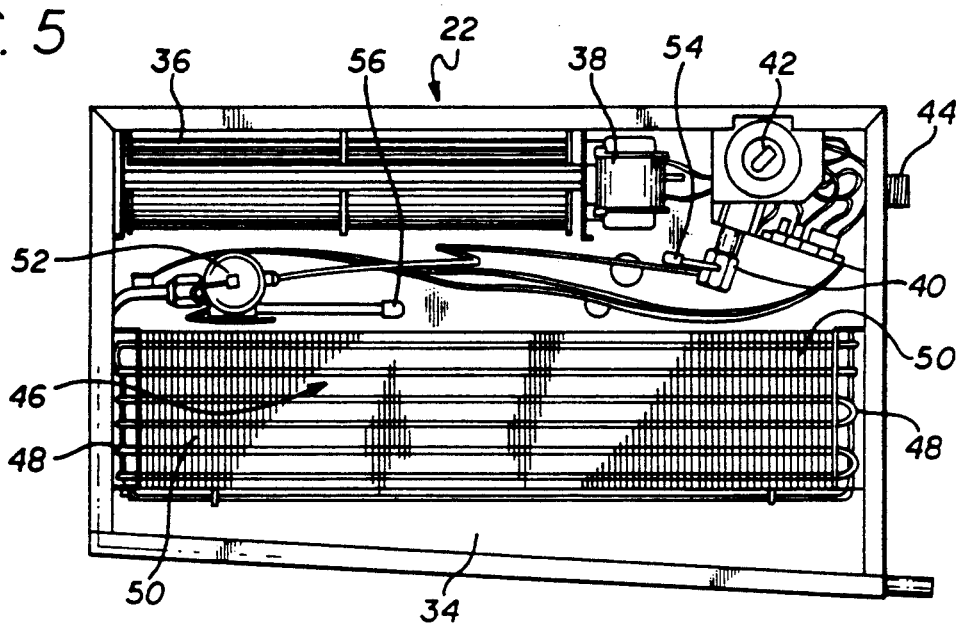
FIG. 6
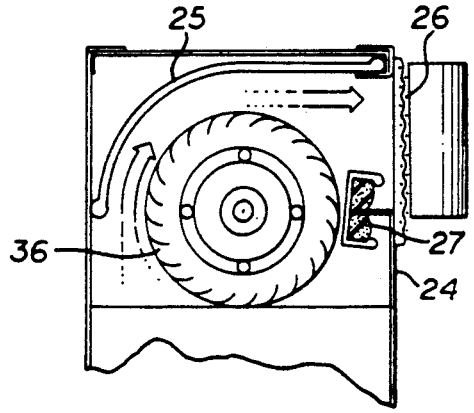
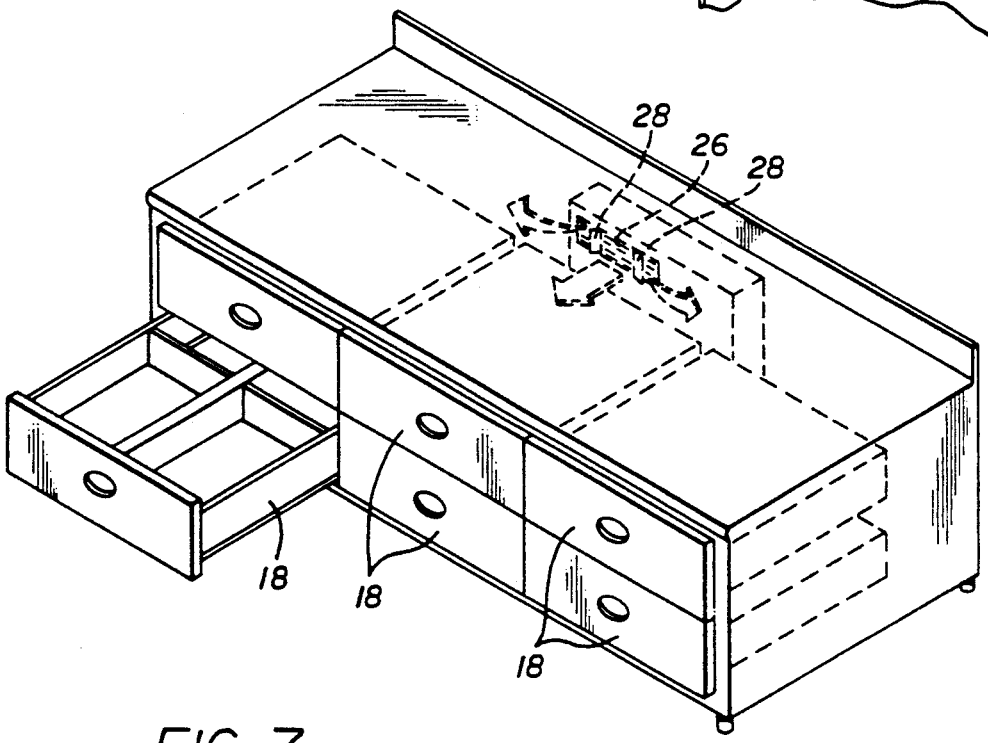
FIG. 7

CABINET REFRIGERATION UNIT

BACKGROUND OF THE INVENTION

The present invention relates generally to refrigeration units and, more particularly, to such units which are self-contained and compact enough to be removably mounted inside of standard food storage and display cabinets.

1. Field of the Invention

Food cabinet refrigeration units are well known in the art and many such refrigeration units are available on the market for a variety of purposes and in a variety of configurations. For example, U.S. Pat. No. 3,699,870 discloses an insulated refrigerated container for transporting large quantities of chilled or frozen foodstuffs or perishable commodities. Also, U.S. Pat. No. 3,577,744 shows a refrigeration system for a food display cabinet which includes a secondary evaporation unit to control the cabinet's humidity. However, up to the present time, most food cabinet refrigeration units suffer from several deficiencies.

First, prior refrigeration units are generally too large and bulky to be conveniently placed inside certain types of food storage and display cabinets. Such refrigeration units, if placed outside the cabinet, take up valuable storage or work space and, if placed inside the cabinet, significantly reduce the amount of usable space within the cabinet.

Another disadvantage of prior refrigeration units in that they fail to provide optimum cooling conditions in certain types of food storage and display cabinets by not adequately controlling the direction of flow of cooled conditioned air with respect to the portions of the cabinet most in need of cooling.

Yet another problem with prior refrigeration units is that they are often designed to be an integral part of the cabinets they are intended to cool, thereby making replacement or repair of the refrigeration unit more difficult and costly and eliminating the ability to interchange refrigeration units with different cabinets.

Accordingly, it is an object of the present invention to provide a relatively small and compact refrigeration unit suitable for convenient mounting inside certain food storage and display cabinets without significantly reducing the amount of usable space within the cabinet or significantly interfering with other portions of the cabinet such as drawers, shelves, bins or the like.

Yet another object of the present invention is to provide optimum cooling conditions in certain types of food storage and display cabinets by allowing control of the direction of flow of cooled conditioned air with respect to the portions of the cabinet most in need of cooling.

Yet a further object of the present invention is to provide a refrigeration unit that is self-contained, thereby facilitating its ability to be repaired, replaced or interchanged into other food storage or display cabinets.

SUMMARY OF THE INVENTION

In accordance with the specific embodiments illustrating the principles of the present invention, instead of providing a refrigeration unit that is large or bulky or is an integral part of the cabinet it is designed to cool, a different configuration is employed.

Specifically, the present invention pertains to cabinet refrigeration systems for use in connection with certain types of food storage or display cabinets and includes a cabinet for storing or displaying refrigerated food and having drawers, shelves, bins or the like. The drawers, shelves, bins and other food storage or display receptacles may be located inside the cabinet, in which case they may be accessed through the front of the cabinet by pulling open the drawer or opening doors placed in the front of the cabinet for that purpose. The food storage receptacles may also be formed into or located on the top of the cabinet, as in the case of bins, in which case the contents of the receptacles may be on display or covered with some suitable cover. A thin refrigeration unit is removably mounted on one of the inner side walls of the cabinet and operates by drawing warm air into the bottom of the unit and expelling cold conditioned air out of the top of the unit. The refrigeration unit is of a relatively compact size and is easily mountable on an inner side wall of the cabinet without detracting significantly from the usable space within the cabinet.

The refrigeration unit is in a housing and the top of the housing includes an elongated output vent through which cold air may be directed out of the unit. The location of the output vent substantially corresponds to an elongated centrifugal fan mounted inside the refrigeration unit housing so that cold air driven by the fan is expelled from the housing through the output vent. Deflectors, or cold-air-director vanes are mounted on the outside of the refrigerator unit housing at the output vent for precisely controlling the direction of flow of the cold air exiting the output vent. The deflectors may be adjustable for changing the direction of cold air flow to suit specific operational configurations. Also, the refrigeration unit may be mounted at various locations on the inner side walls of the cabinet to suit various configurations of drawers, shelves, bins or the like.

A remotely located compressor/condenser unit, connected to the refrigeration unit with suitable tubing, allows for closed-loop circulation of an appropriate coolant material through the refrigeration unit.

Other objects, features and advantages of the invention will become apparent from a consideration of the following detailed description and from the accompanying drawings.

BRIEF DESCRIPTION OF THE DRAWINGS

FIG. 1 is a perspective view of a cabinet refrigeration system illustrating the principles of the present invention and showing a refrigeration unit in dotted lines;

FIG. 2 is a cross-sectional side view of a cabinet refrigeration system showing a refrigeration unit and several food storage/display receptacles;

FIG. 3 is a front view of a refrigeration unit illustrating the principles of the present invention;

FIG. 4 is a side view of a refrigeration unit illustrating the principles of the present invention;

FIG. 5 is a front view of a refrigeration unit with the front cover removed;

FIG. 6 is a cross-sectional view taken along line 6—6 of FIG. 3;

FIG. 7 is a perspective view of a cabinet refrigeration system illustrating the principles of the present invention and showing a refrigeration unit and food storage receptacles in dotted lines;

DETAILED DESCRIPTION OF THE PREFERRED EMBODIMENT

Figure 8:
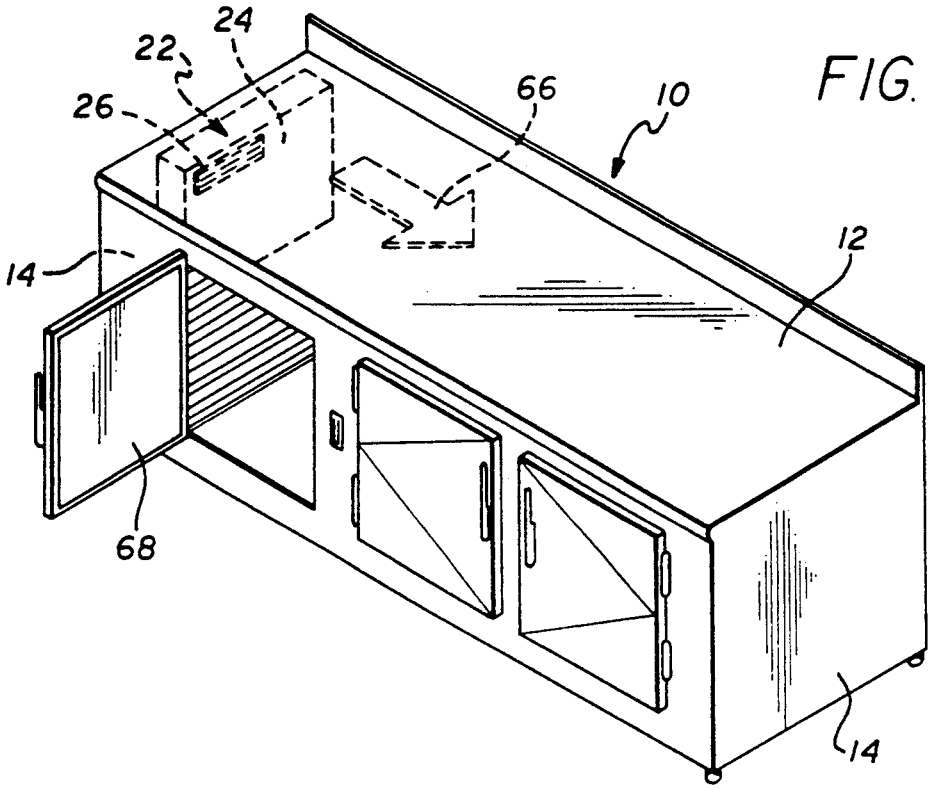
FIG. 8 is a perspective view of a cabinet refrigeration system showing a refrigeration unit in dotted lines.

Referring more particularly to the drawings, FIG. 1 is a perspective view of a cabinet refrigeration system 10, showing a cabinet 12 having side walls 14 a top wall 16 and drawers 18 and bins 20 for food storage or display. It is to be understood that cabinet 12 may included methods of food storage or display, such as shelves, sliding racks and the like, other than those specifically shown. A refrigeration unit 22 having a housing 24 and an elongated output vent 26 toward the top of the housing 24 is removably mounted on the inside of a side wall 14 of cabinet 12. A deflector or cold-air-director vane 28 is mounted on housing 24 at output vent 26.

In accordance with one embodiment of the invention, and as best seen in FIG. 2, refrigeration unit 22 may be mounted on the inner surface 30 of the rear most side wall of cabinet 12 with output vent 26 and deflector 28 oriented to direct the flow of cold air upward to the bottom surfaces of bins 20 and over the top of the food storage drawers 18 as indicated by arrow 32. It may be noted that in the preferred embodiment refrigeration unit 22 is relatively thin and compact with a housing 24 depth of not more than about 6 inches, thereby providing a refrigeration unit 22 that does not take up any significant amount of the usable space inside cabinet 12, and is easily removed, replaced or interchanged with other refrigeration units.

It is to be understood that the direction of air flow out of output vent 26 may be adjusted by suitably positioning deflector 28 so that the direction of air flow meets the needs of the particular cabinet 12 in which refrigeration unit 22 is installed. This aspect of the present invention is well illustrated in FIG. 7 which shows deflectors 28 positioned so as to direct the air flow out of output vent 26 in directions that will provide maximum cooling for drawers 18. It is to be further understood that deflectors 28 may either be fixed or may be adjustable to suit to needs of a particular cabinet refrigeration system.

As is best seen in FIGS. 3 and 4, refrigeration unit 22 has an elongated input vent 34 running adjacent to the lower portion of housing 24. As will be described more particularly below, warm air is drawn into refrigeration unit 22 through input vent 34, cooled by the refrigeration unit 22 and expelled through output vent 26. In accordance with the preferred embodiment of the invention, output vent 26 is located at the top-most portion of housing 24 to allow for the most efficient operation of refrigeration unit 22 and to facilitate the directing of cool air against surfaces of the drawers 18 and bins 20 of cabinet 12 which are most in need of cooling and over the top of the drawers and shelves within the cabinet. With cold air normally falling and hot air rising, directing cold air over the top of the drawers and shelves insures cooling of the entire contents of the cabinet.

As is best seen in FIGS. 5 and 6, refrigeration unit 22 includes an elongated centrifugal fan 36 powered by motor 38 and located immediately behind and in substantial alignment with output vent 26 in housing 24. Baffles 25 and 27 direct air from centrifugal fan 36 out vent 26 at the top of refrigeration unit 22. A solenoid valve 40 controlled by thermostat 42 and sensing coil 44 is contained in refrigeration unit 22. In accordance with one embodiment of the invention, thermostat 42 extends through housing 24 to be accessible for adjustment on the outside of housing 24 (see FIG. 3). Also, sensing coil 42 extends through housing 24 to monitor the temperature within cabinet 12.

Also contained within housing 24 of refrigeration unit 22 is an evaporator assembly 46 including evaporator tubing 48 and cooling vanes 50, an expansion valve 52 and coolant material input and output tubes 54 and 56, respectively.

Figure 9:
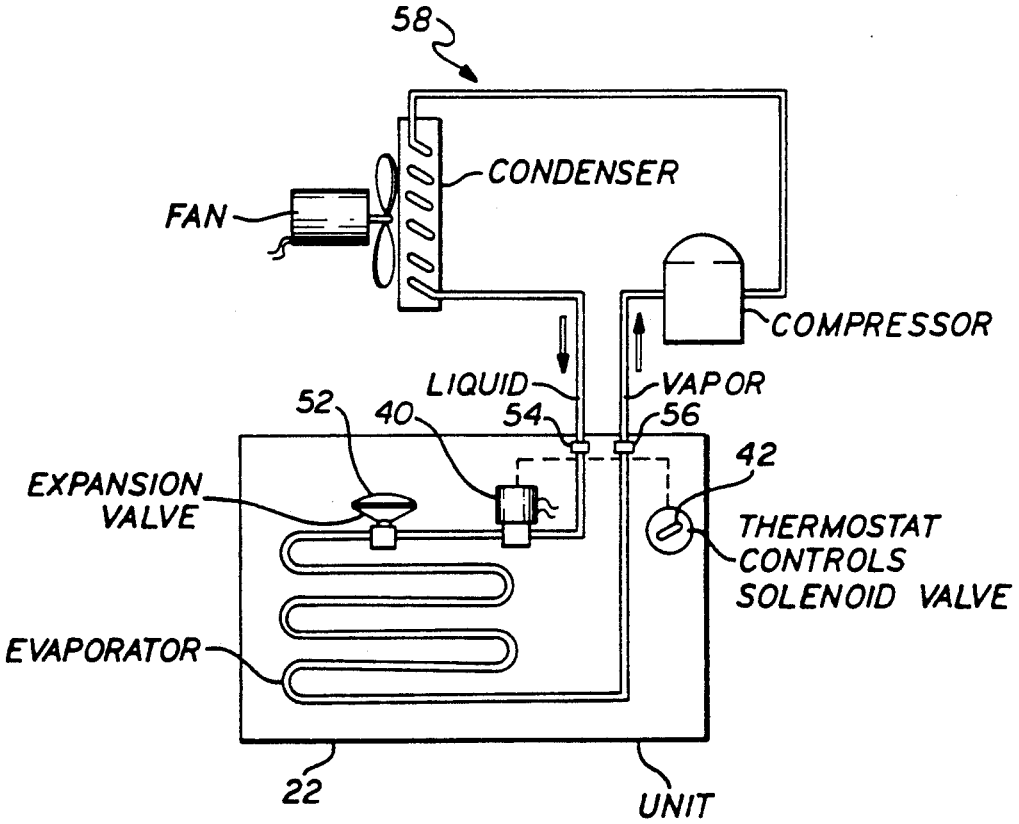
FIG. 9 is a schematic diagram of a refrigeration system.

As is best illustrated in the schematic diagram in FIG. 9, refrigeration unit 22 functions as follows:

Coolant material of a suitable type such as freon is contained in a closed-loop circulation system 58. Coolant material in liquid form enters refrigeration unit 22 through coolant input tube 54. The flow of liquid coolant material through input tubing 54 is controlled by solenoid 40. Solenoid 40 is in turn controlled by the interaction of sensing coil 44 and thermostat 42. Liquid coolant then passes through expansion valve 52 causing the coolant to expand into a gaseous state and thereby cooling down evaporation tubing 48 of evaporator assembly 46. Cooling vanes 50 are in turn cooled by evaporation tubing 48 and warm air, as it is drawn in through input port 34, is cooled down as it passes around evaporator assembly 46. This cooled air is then forced out of housing 24 of refrigeration unit 22 into the inside of cabinet 12. The now gaseous coolant material exits refrigeration unit 22 through coolant output tubing 56 where it travels through closed loop circulation system 58 to a compressor 60. The coolant material is then compressed and run through a condenser in the course of which it is reconverted to a liquid for circulation back into refrigeration unit 22. A fan assembly 64 provides for the conduction of heat away from condenser 62. It is to be noted that compressor 60, condenser 62 and fan assembly 64 are remotely located away from cabinet refrigeration system 10 and are normally located outdoors when cabinet refrigeration system 10 is located indoors. FIG. 9 is included for purposes of completeness, as systems of this general type are of course known per se.

FIG. 8 illustrates another embodiment of a cabinet refrigeration system. In the FIG. 8 embodiment, refrigeration unit 22 is removably mounted on the inside surface of the left-most side wall 14 of cabinet 12. In this position the air flow, represented by arrow 66 from output vent 26 in housing 24 may be oriented in a direction suitable for flowing air over the top of food stored in a differently configured food storage cabinet 12, such as one shown in FIG. 8 which includes doors 68 in its front wall rather than drawers or display bins. The cabinet of FIG. 8 may have open racks or wire shelves for storing food.

One set of dimensions for a removably mounted refrigeration unit 22 which has been tested and found to be satisfactory involves units which are 13¾ inches high, 4½ inches deep and having a length between 16 inches and 24 inches, depending on the desired cooling capacity. However, these dimensions are not controlling, and units which are longer, for example up to three feet long, and which are up to two feet high, could be used. However, as to depth, it is important that the units be relatively thin, less than eight inches thick, and preferably less than six inches thick.

In conclusion, it is to be understood that the foregoing descriptions an accompanying drawings relate to only some of the preferred embodiments of the present invention. Other embodiments may be utilized without departing from the spirit and scope of the invention. Thus, by way of example and not of limitation, the air flow output from output vent 26 may be divided up by appropriately placed deflectors 28 and thereby oriented in a number of different directions simultaneously. Also, the thermostat control 42 might be positioned so that it could be accessed from the outside of cabinet 12 for easy adjustment. Similarly, sensing coil 44 could be positioned at various places within cabinet 12 to monitor the temperature at specific locations within the cabinet. Accordingly, it is to be further understood that the detailed description and drawings set forth hereinabove are for illustrative purposes only and do not constitute a limitation on the scope of the invention.

What is claimed is:

1. A refrigeration system including a self-contained refrigeration unit for removable mounting in a cabinet for storing food comprising:

a refrigeration unit including a housing containing evaporator tubing and cooling vanes;

said housing being relatively thin, and having a depth of not more than six inches;

said housing having an air inlet at the bottom thereof, and means for directing cold air out from said refrigeration unit into and across the upper volume of said cabinet to flow down and refrigerate the volume of the cabinet, said means including an elongated air outlet extending along one side surface at the top of said unit;

fan means for directing air out of said outlet after passing from said inlet over said cooling vanes;

said refrigeration unit being structurally independent of and located wholly within said cabinet; and a separate compressor and condenser located outside of said refrigeration unit and said cabinet and coupled to said refrigeration unit by conduits;

whereby said refrigeration unit may be easily replaced, repaired, or moved to a different cabinet.

2. A self-contained refrigeration unit for removable mounting in a cabinet for storing food as defined in claim 1 wherein said fan means includes an elongated centrifugal fan having a length comparable to that of said elongated air outlet.

3. A self-contained refrigeration unit for removable mounting in a cabinet as defined in claim 1 further comprising at least one deflector vane for directing air from said outlet.

4. A refrigeration system including a self-contained refrigeration unit for removable mounting in a cabinet for storing food as defined in claim 1 further comprising a plurality of adjustable deflector vanes for directing air from said outlet.

5. A refrigeration system including a self-contained refrigeration unit for removable mounting in a cabinet for storing food as defined in claim 4 wherein said plurality of adjustable deflector vanes are adjustable independent of one another.

6. A refrigeration system including a self-contained refrigeration unit for removable mounting in a cabinet for storing food as defined in claim 1 wherein said cabinet for storing food further comprises a plurality of drawers slidably engaging said cabinet.

7. A refrigeration system including a self-contained refrigeration unit for removable mounting in a cabinet for storing food as defined in claim 1 further comprising means for adjusting the temperature of air directed out of said elongated air outlet.

8. A refrigeration system including a self-contained refrigeration unit for removable mounting in a cabinet for storing food as defined in claim 5 further comprising means for adjusting the temperature of air directed out of said elongated air outlet.

9. A refrigeration system including a self-contained refrigeration unit for removable mounting in a cabinet for storing food comprising:

a refrigeration unit including a housing containing evaporator tubing and cooling vanes;

said housing being relatively thin and having a depth of less than eight inches;

said housing having an air inlet at the bottom thereof, and means for directing cold air out from said refrigeration unit into and across the upper volume of said cabinet to flow down and refrigerate the volume of the cabinet, said means including an elongated air outlet extending along one side surface at the top of said unit;

fan means for directing air out of said outlet after passing from said inlet over said cooling vanes;

said refrigeration unit being structurally independent of and located wholly within said cabinet; and a separate compressor and condenser located outside of said refrigeration unit and said cabinet and coupled to said refrigeration unit by conduits;

whereby said refrigeration unit may be easily replaced, repaired, or moved to a different cabinet.

10. A refrigeration system including a self-contained refrigeration unit for removable mounting in a cabinet for storing food comprising:

a refrigeration unit including a housing containing evaporator tubing and cooling vanes;

said housing being relatively thin, and having a depth of not more than 6 inches;

said housing having an air inlet at the bottom thereof and means for directing cold air out from said refrigeration unit into and across the upper volume of said cabinet to flow down and refrigerate the volume of the cabinet, said means including an elongated air outlet extending along one side surface at the top of said unit;

fan means for directing air out of said outlet after passing from said inlet over said cooling vanes;

said fan means including an elongated centrifugal fan having a length comparable to that of said elongated air outlet;

a plurality of deflector vanes for directing air from said air outlet;

said deflector vanes being adjustable independent of one another for controlling the direction of air from said air outlet;

means for adjusting the temperature of air directed out of said air outlet;

said refrigeration unit being structurally independent of and located wholly within said cabinet; and a separate compressor and condenser located outside of said refrigeration unit and said cabinet and coupled to said refrigeration unit by conduits;

whereby said refrigeration unit may be easily replaced, repaired, or moved to a different cabinet.

11. A system as defined in claim 10 further comprising food storage receptacles mounted in said cabinet.

12. A system as defined in claim 1 wherein the top of said unit is closed and the outlet is only in the side wall of said unit.

* * * * *